US012662776B2

(12) United States Patent
Scafarti

(10) Patent No.: US 12,662,776 B2
(45) Date of Patent: Jun. 23, 2026

(54) METHOD FOR PRODUCING SHAPED PRODUCTS FROM A PLURALITY OF PAPER LAYERS ARRANGED ONE ABOVE ANOTHER

(71) Applicant: OPTIMA consumer GmbH, Schwäbisch Hall (DE)

(72) Inventor: Jens Scafarti, Sundern (DE)

(73) Assignee: OPTIMA consumer GmbH, Schwäbisch Hall (DE)

( * ) Notice: Subject to any disclaimer, the term of this patent is extended or adjusted under 35 U.S.C. 154(b) by 164 days.

(21) Appl. No.: 18/713,447

(22) PCT Filed: Oct. 19, 2022

(86) PCT No.: PCT/IB2022/060038
§ 371 (c)(1),
(2) Date: May 24, 2024

(87) PCT Pub. No.: WO2023/094910
PCT Pub. Date: Jun. 1, 2023

(65) Prior Publication Data

US 2025/0052011 A1 Feb. 13, 2025

(30) Foreign Application Priority Data

Nov. 26, 2021 (EP) ..... 21020601

(51) Int. Cl.
*D21J 3/00* (2006.01)
*D21J 5/00* (2006.01)

(52) U.S. Cl.
CPC .. *D21J 3/00* (2013.01); *D21J 5/00* (2013.01)

(58) Field of Classification Search
CPC ..... D21J 3/00; D21J 5/00; B65D 1/28; B65D 65/466
See application file for complete search history.

(56) References Cited

U.S. PATENT DOCUMENTS

| | | | | |
|---|---|---|---|---|
| 11,717,993 | B2 * | 8/2023 | Larsson | D21J 5/00 264/257 |
| 2021/0164163 | A1 | 6/2021 | Statelman et al. | |
| 2025/0052011 | A1 * | 2/2025 | Scafarti | D21J 3/00 |

FOREIGN PATENT DOCUMENTS

| | | | | |
|---|---|---|---|---|
| CA | 3100441 | C * | 9/2023 | |
| CN | 104271818 | A * | 1/2015 | B32B 5/08 |
| CN | 118475745 | A * | 8/2024 | D21J 5/00 |
| DE | 102013103743 | A1 | 10/2014 | |
| DE | 202018104061 | U | 10/2019 | |
| EP | 4105383 | A1 * | 12/2022 | B65D 1/28 |
| GB | 2456502 | A | 7/2009 | |
| JP | S50143686 | | 11/1975 | |

(Continued)

OTHER PUBLICATIONS

Japanese Patent Office, Decision to Grant a Patent in related patent application No. 2024-531453, Mar. 27, 2026.

*Primary Examiner* — Jose A Fortuna
(74) *Attorney, Agent, or Firm* — Smartpat PLC

(57) ABSTRACT

A method for producing shaped products from multi-layer paper dispenses with subsequent drying steps and still allows entirely compostable shaped products to be produced that, in terms of their shape, are not limited to flat angles between flat regions. A corresponding shaped product made of paper and to a device for carrying out the method are disclosed.

12 Claims, 1 Drawing Sheet

(56) References Cited

FOREIGN PATENT DOCUMENTS

| | | | | | |
|---|---|---|---|---|---|
| JP | H06134898 | A | | 5/1994 | |
| JP | 2003025315 | A | | 1/2003 | |
| JP | 2024541543 | A | * | 11/2024 | ..... D21J 5/00 |
| KR | 20240144104 | A | * | 10/2024 | ..... D21J 5/00 |
| TW | 200728558 | A | | 8/2007 | |
| WO | 2019241363 | A1 | | 12/2019 | |
| WO | WO-2023094910 | A1 | * | 6/2023 | ..... D21J 5/00 |

* cited by examiner

METHOD FOR PRODUCING SHAPED PRODUCTS FROM A PLURALITY OF PAPER LAYERS ARRANGED ONE ABOVE ANOTHER

CROSS-REFERENCE TO RELATED APPLICATION

This application is a national stage application, filed under 35 U.S.C. § 371, of International Patent Application PCT/IB2022/060038, filed on Oct. 19, 2022, which claims the benefit of European Patent Application EP 21020601.7, filed on Nov. 26, 2021.

TECHNICAL FIELD

The disclosure relates to a method for producing shaped products from multi-layer paper, which dispenses with subsequent drying steps and which still allows entirely compostable shaped products to be produced which, in terms of their shape, are not limited to flat angles between flat regions. The disclosure also relates to a corresponding shaped product made of paper and to a device for carrying out the method.

BACKGROUND

As the global mail-order trade in goods of all kinds increases, so does the need for packaging material. In addition to thermoformed packaging made from thermoplastics, compostable packaging is becoming increasingly important for ecological reasons. Cartons in which fragile chicken eggs are transported are usually made of cardboard and fulfill the criterion of compostability. These egg cartons are produced using a process known as fiber casting, in which the first step usually involves dissolving waste paper from corrugated cardboard in water in order to defibrillate the paper fibers and prepare them to take a new shape. In a second step, a first shaping tool is then dipped into a container with the fiber pulp and the excess water suctioned out of the container from below so that the paper fibers collect on the shaped top side of the tool. A second shaping tool then shapes the top side of the fiber pulp deposited on the first shaping tool, wherein both tools, together with the fiber pulp between them, are removed upwards from the container. In the final step, the pre-formed fiber pulp is placed in a drying oven, where the fibers are then closely bonded together so that no glue needs to be added. After the drying step, the shaped part is ready for use. The disadvantages of this method are, on the one hand, the energy consumption due to the high water content in the method and the required drying step and, on the other hand, the slow speed at which production can take place due to the method. The ecological footprint of the shaped products produced in this way is thus worse than many users perceive.

With many types of packaging, the intention is merely to give the impression of meeting ecological demands, as shown, for example, in patent specification DE 10 2013 103 743 B4. One of the disadvantages of plastic packaging produced using the thermoforming method is that such packaging can be seen at first glance to be made of plastic, which is no longer desirable in many applications today because, for example, the product contained in the packaging has an ecological aspect or the packaging should at least give an environmentally friendly impression for other reasons. The limitation of cardboard packaging as an alternative due to its less freely definable shape is also mentioned in the patent document. The object of the invention presented therein is to create thermoformed packaging which consists on the one hand of the thermoformed plastic body and on the other hand of an insert made of another material, such as a paper material, which is an integral part of the packaging without glue and which allows the insert to be separated from the plastic body after use without difficulty. This is a further development of thermoformed plastic packaging which is subsequently flocked with paper fibers to give the optical appearance of packaging made of paper material and, disadvantageously, does not allow the components to be separated with reasonable effort during disposal.

Utility model DE 20 2018 104 061 U1 also addresses the ecological aspects of packaging material. According to the utility model, there are numerous types of packaging available that consist of plastic or bleached paper/cardboard and are printed to resemble paper. The feel is also made to resemble paper very closely in some cases by using special varnishes. The aim here is to present consumers with the naturalness they expect in the "look of paper and its feel to the touch", but without actually being sustainable. The object formulated in the utility model specification is to provide folding cartons for frozen foods, which cartons can be oiled or coated with wax or silicone. So-called kraft cardboard is to be used here. The disadvantage here again is the restriction in the shape, which mainly only allows folding boxes to be provided.

The simple pressing of multi-layer paper into shaped products, such as paper plates with the usual corrugation on the edge of the plate, is subject to shaping limitations, which are due to the lack of stretchability of paper and allow only very flat angles between flat regions or flat wave shapes. Such products further require the addition of glue to ensure a close bond between the individual paper layers. However, this stands in the way of complete compostability.

SUMMARY

The present disclosure teaches how to make completely compostable, elastomer- and glue-free shaped products made of paper which, although they can be produced by means of a faster and energy-saving method compared to the usual fiber casting method, are subject to fewer limitations with regard to their shaping than shaped products produced by methods other than fiber casting, which require the use of glue. At the same time, a production method for such shaped products made of paper is to be presented and a device for carrying out such a method provided.

A method relates to producing shaped products from multi-layer paper, wherein each of the paper layers respectively has a plurality of free fiber ends on its surfaces. These fiber ends are important to the method, as they are oriented transversely to the paper layers in order to form a close bond with one another even while the paper layers are being pressed into the desired shaped product. The method thus comprises a first step in which a plurality of paper layers arranged one above the other are fed between a positive mold and a negative mold, which is complementary to the positive mold, of a pressing tool. In a second step, the aligning of the free fiber ends transverse to the paper layers takes place, wherein a gas or gas mixture, preferably ambient air, flows through the paper layers or, conversely, is suctioned through and from them, wherein the flow direction of the gas or gas mixture corresponds to the desired alignment of the fiber ends, ideally transverse to the top and bottom sides of the paper layers. The fiber ends can be aligned upstream from the pressing tool or preferably within the pressing tool, i.e., between the positive and negative mold of the pressing tool. In a third step, the individual paper layers are then pressed to form a shaped product corresponding to the positive and the negative mold and removed from the pressing tool without the need for any further steps, such as energy-intensive drying, apart from a separating cut during the preferred feeding of continuous paper layers in the first method step.

It is advantageous if the second method step takes place between the positive and the negative mold of the pressing tool. Preferably, pressing tools are used which have at least one pressing surface that is gas-permeable or perforated at least in some regions, so that the suctioning off or feeding of the gas or gas mixture for aligning the fiber ends takes place through one or a plurality of such pressing surfaces. In this way, the flow direction corresponds to a vector oriented transversely to the desired shape.

For shaping the shaped part intended by the method, it is advantageous to use creped, cellulose-containing tissue paper which is stretchable by 20% or more at least in partial regions. Since the outer paper layer is stretched more than the inner paper layer when the direction within the mold changes, for example when two flat regions of a shaped part form an angle of almost 90°, it is advantageous if the creping of the paper used allows the paper to be stretched by 50% or more, at least in partial regions. A stretchability of 20%, for example, means that a paper layer of, for example, 100 cm in length can be stretched to a length of 120 cm without tearing.

Preferably, suctioning off the gas or gas mixture in the second method step creates a negative pressure relative to the ambient pressure, at least for a short time, since in this way the fiber ends are very well aligned, which benefits the bonding of the individual paper layers to one another after the third method step. It is also advantageous if the solvent or solvent mixture, in particular water, is localized for the most part on the surfaces of the paper layers shortly beforehand by spraying or vaporizing or both at the same time and has not yet penetrated deeper into the individual paper layers, since it can thus evaporate more quickly as a result of the suctioning off or feeding of the gas or gas mixture acting in the second step than if the same solvent or solvent mixture content were to penetrate the individual paper layers evenly and completely. During accelerated evaporation, the fiber ends are erected in the desired manner transversely to the surfaces of the paper layers.

In a favorable implementation of the method, the content of the solvent or solvent mixture is reduced to less than 5% of the initial content by suctioning off the gas or gas mixture and by an increased ambient temperature, which can be achieved by heating the pressing tool to 100° C. to 350° C., insofar as the solvent or solvent mixture is not water. If water is used, which is advantageous for the safety of the method, the moisture content relative to the ambient air at 20° C., 50% relative humidity and 1000 hPa ambient air pressure is at least equilibrated or reduced beyond that in the second and third method steps, because paper in principle binds water under the stated conditions, i.e., also in practice, and is not completely free of water. Equilibrated does not mean that the ambient air and the shaped part have the same water content, but that an equilibrium has been established according to the respective absorption capacity. Alternatives to water as a solvent include, for example, a solvent mixture that evaporates faster than water, such as azeotropic ethanol/water mixtures, isopropanol/water mixtures, isopropanol or similar.

As already mentioned, it is advantageous if the individual paper layers are sprayed or vaporized with a solvent or solvent mixture. It is advantageous if this is done between at least two paper layers spaced apart from one another, preferably in the middle of the paper layers positioned on top of one another. During principally continuous feeding of the paper layers from a paper roll, which is only stopped briefly for the pressing procedure, a spacing can be created with the aid of a divider, which spacing then enables the insertion of a spray head or a vaporizing nozzle between the paper layers. However, it is also possible to avoid this effort by using paper layers with an appropriately adjusted solvent or solvent mixture content from the outset, wherein sacrifices may have to be made with regard to the quality of the bond between the individual paper layers in the finished shaped product.

The pressure applied in the third method step for pressing the paper layers to form a shaped product corresponding to the positive and the negative mold of the pressing tool is preferably at least 100 kg per square centimeter. Of course, higher pressures can also be applied if required by the shape. It is advantageous to work with a hot pressing tool with a temperature of 100° C. to 350° C. during pressing, as this promotes the desired evaporation of the solvent or solvent mixture and thus the alignment of the fiber ends.

The method explained is characterized in that paper can advantageously be used as the starting material and in that no additions of glue are required during the method, such as to strengthen the bond of the individual paper layers with one another. This means that the shaped product produced with the method is completely compostable and, of course, recyclable.

Against the background of the method presented, it is now possible to provide a shaped product which is produced from multi-layer paper which, solely due to its creping, has a stretchability of 20% or more, preferably 50% or more, at least in some regions, is completely compostable, and has flat regions directly adjacent to one another which enclose an angle of more than 90° and less than 150°. This also distinguishes such a shaped product from commercially available egg cartons, for example, which are produced using the fiber casting method, since in such case no creping-related stretchability of the paper is determinable.

Finally, a device for producing shaped products from multi-layer paper is briefly presented, which has a roller arrangement for feeding the paper to a pressing tool with a positive mold and a complementary negative mold, wherein the pressing tool can be heated to 100° C. to 350° C. and at least one of the pressing surfaces is gas-permeable or perforated at least in some regions and is connected via a hose to a compressor or a vacuum pump for suctioning in or feeding a gas or gas mixture, preferably ambient air, through the pressing surface.

It is advantageous if an outlet for a solvent or solvent mixture, preferably for water, is arranged upstream from the pressing tool, which outlet is designed for nebulizing or vaporizing the solvent or solvent mixture, wherein the transport device for the individual paper webs is configured so that the outlet, which may be a spray head, a multi-spray head or a vaporization or multi-vaporization nozzle, for example, is positionable between the paper layers.

The invention is explained in greater detail below with reference to the drawings, without being limited to the examples shown.

DETAILED DESCRIPTION

Figure 1:
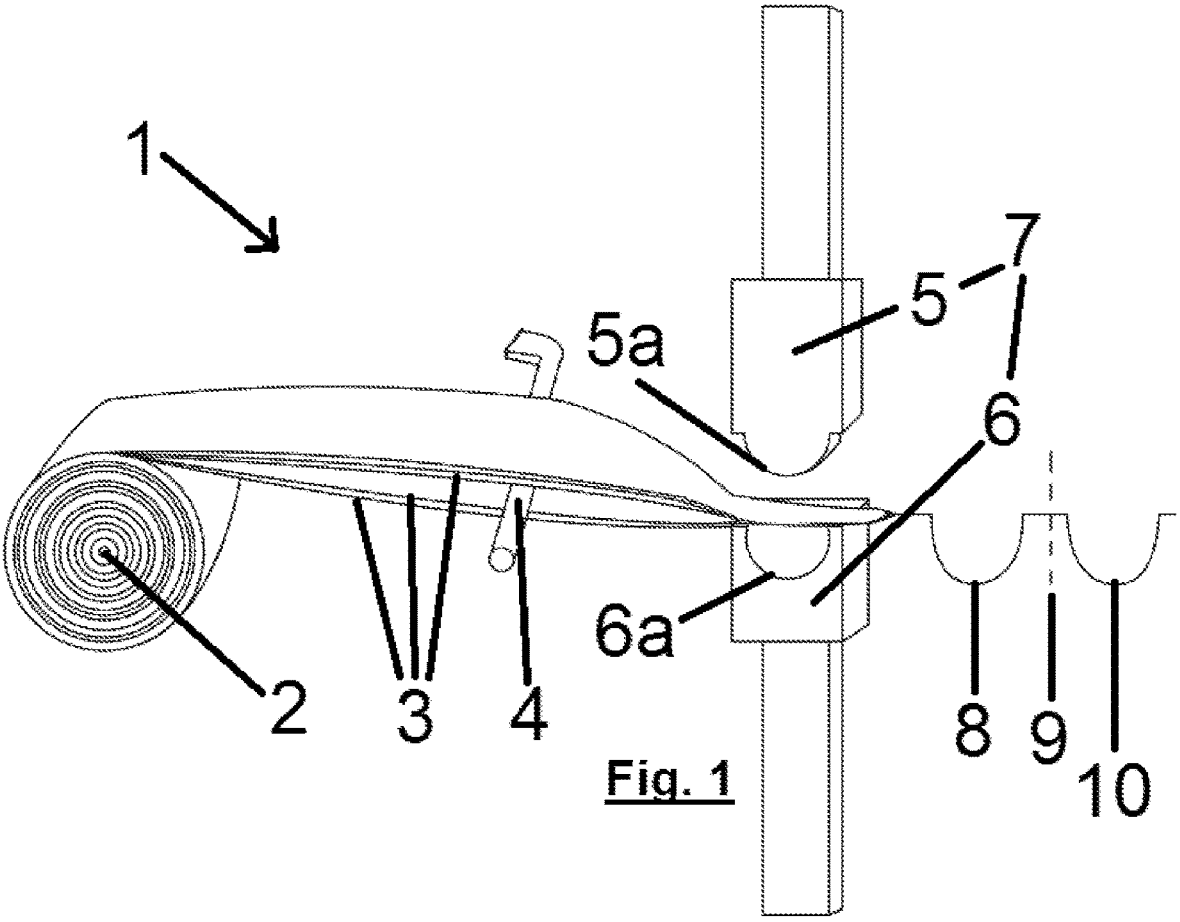
FIG. 1 shows a device for producing shaped products from multi-layer paper.

FIG. 1 shows a sketch of the device for producing shaped products from multi-layer paper. The roller arrangement is indicated, which is not necessarily arranged to the side of the pressing tool (7), as shown, but can also be arranged above this (7), for example, in order to utilize the force of gravity when feeding the paper. The individual paper layers (3) can be seen, which are shown here spaced apart from one another in a simple manner by means of the outlet (4) for the solvent or solvent mixture. They can also be spaced apart from one another by means of an additional divider (not shown) positioned upstream from the outlet (4). The multi-layer paper fed over the outlet is guided to the pressing tool (7), whose positive mold (5) engages with pressure in the complementary negative mold (6) and thereby causes the forming of the fed paper into the desired, here highly schematized, shaped product (8), which is separated as an individual part by a cut along the cutting edge (9), as outlined by the previously formed shaped product (10). The pressing surfaces (5*a*, 6*a*) have perforations (not shown) through which a gas or gas mixture, in this case ambient air, is suctioned off, even during the pressing process. This creates a negative pressure relative to the ambient pressure, at least for a short time. The hoses leading from the perforations to a vacuum pump (not shown) run advantageously within a sketched cover of the pressing tool. For the sake of simplicity, the feed for the solvent or solvent mixture intended for wetting the paper layers is also not shown.

Figure 2:
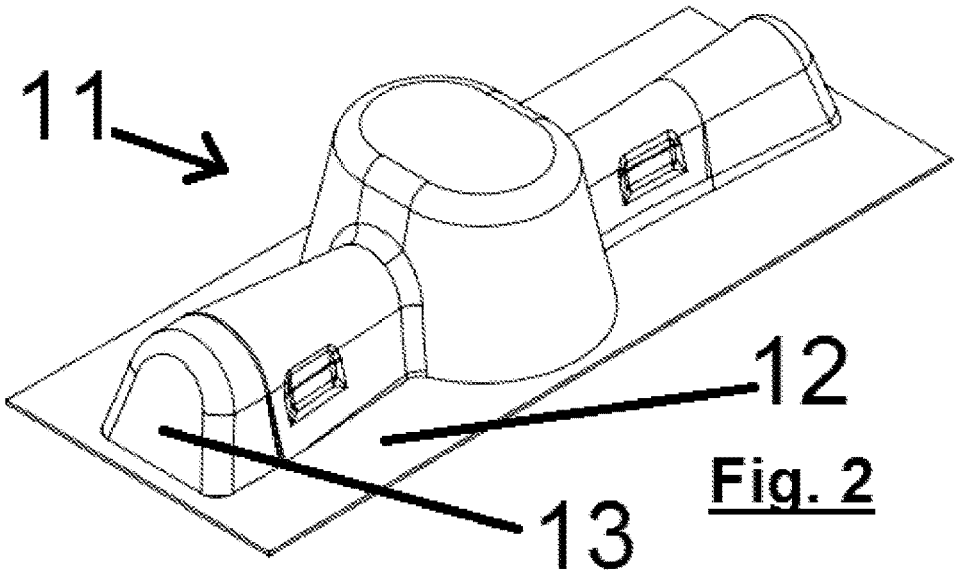
FIG. 2 shows an example of a shaped product produced from multi-layer paper.

FIG. 2 shows an example of a somewhat more complicated shaped product, which was produced here from multi-layer paper by means of the method described above and shows two directly adjoining flat regions (12, 13) which enclose an angle of slightly more than 90° but less than 150° at the end face of the shaped product (11), which in the case of production from multi-layer paper, in contrast to production by the fiber casting method, is only possible without the addition of elastomers if the paper used has a stretchability of 20% or more, in this case more than 50%, at least in some regions, due to creping.

LEGEND

1 Device for producing shaped products from multi-layer paper
2 Roller arrangement
3 Paper layers
4 Outlet
5 Positive mold
5*a* Pressing surface of the positive mold
6 Negative mold
6*a* Pressing surface of the negative mold
7 Pressing tool
8 Shaped product (still connected)
9 Cutting edge
10 Shaped product (separated)
11 Shaped product
12 First flat region
13 Second flat region

The invention claimed is:

1. A method for producing shaped products from a plurality of paper layers, comprising:

i) feeding the plurality of paper layers arranged one above another between a positive mold and a complementary negative mold of a pressing tool with pressing surfaces, each of the paper layers having a plurality of free fiber ends on its surface;

ii) aligning the free fiber ends transversely to top and bottom sides of the paper layers by suctioning off or feeding a gas or gas mixture, wherein a flow direction of the gas or gas mixture corresponds to a desired alignment; and iii) pressing the paper layers to form a shaped product corresponding to the positive mold and the complementary negative mold by the pressing tool.

2. The method according to claim 1,
wherein at least one pressing surface is gas-permeable or perforated at least in some regions and the suctioning off or feeding according to step ii) takes place through at least one pressing surface.

3. The method according to claim 1,
wherein the multi-layer paper is a creped, cellulose-containing tissue paper, which is stretchable by 20% or more at least in partial regions.

4. The method according to claim 1,
wherein the suctioning off of the gas or gas mixture in step ii) creates a negative pressure relative to an ambient pressure between the positive mold and the complementary negative mold.

5. The method according to claim 1,
wherein the paper layers have a solvent or solvent mixture at least in step ii).

6. The method according to claim 5,
wherein suctioning off of the gas or gas mixture in step ii) creates a reduced pressure that increases evaporation of the solvent or solvent mixture relative to ambient conditions.

7. The method according to claim 5,
wherein a content of the solvent or solvent mixture in steps ii) and iii) is reduced to less than 5% of an initial content or, if the solvent is water, to a moisture content of the shaped product which is less than or equal to a moisture equilibrium between the shaped product and ambient air at 20° C., 50% relative humidity and 1000 hPa ambient air pressure.

8. The method according to claim 5,
wherein at least two of the paper layers are spaced apart from one another during the feeding according to step i).

9. The method according to claim 8,
wherein the solvent or solvent mixture is nebulized, evaporated, or nebulized and evaporated between the paper layers spaced apart from one another during the feeding of the paper layers according to step i).

10. The method according to claim 1,
wherein a pressure during pressing according to step iii) is at least 100 kg/cm$^2$.

11. The method according to claim 1,
wherein a temperature of the pressing tool in step iii) is 100° C. to 350° C.

12. The method according to claim 1,
wherein a composition of the multi-layer paper is free of elastomer additives and the shaped product is completely compostable.

* * * * *